United States Patent [19]

Houde

[11] Patent Number: 4,747,594

[45] Date of Patent: May 31, 1988

[54] PORTABLE EXERCISE DEVICE FOR USE IN A DOORWAY

[76] Inventor: Roger Houde, #2, 10031-153 St., Edmonton, Alberta, Canada, T5P 2B1

[21] Appl. No.: 842,977

[22] Filed: Mar. 24, 1986

[30] Foreign Application Priority Data

Feb. 18, 1986 [CA] Canada ..... 502136

[51] Int. Cl.[4] ..... A63B 27/00

[52] U.S. Cl. ..... 272/72; 272/136; 272/134; 272/900

[58] Field of Search ..... 272/72, 118, 116, 133, 272/134, 135, 136, 142, 143, 900

[56] References Cited

U.S. PATENT DOCUMENTS

| | | | |
|---|---|---|---|
| 679,784 | 8/1901 | Ryan | 272/136 |
| 726,095 | 4/1903 | Nightingale | 272/136 |
| 1,750,549 | 3/1930 | Thomson et al. | 272/72 |
| 2,209,034 | 7/1940 | Paul | 272/72 X |
| 3,524,644 | 8/1970 | Kane | 272/134 |
| 3,614,097 | 10/1971 | Blickman | 272/72 |
| 3,840,227 | 10/1974 | Chesemore | 272/118 |
| 3,850,431 | 11/1974 | Winans | 272/134 X |
| 4,093,214 | 6/1978 | Coker et al. | 272/143 X |
| 4,231,568 | 11/1980 | Riley et al. | 272/136 |
| 4,293,127 | 10/1981 | Dudley | 272/133 |
| 4,431,181 | 2/1984 | Baswell | 272/118 X |

FOREIGN PATENT DOCUMENTS 8601735 3/1986 World Int. Prop. O. ..... 272/72

*Primary Examiner*—Richard J. Apley
*Assistant Examiner*—David Bender

[57] ABSTRACT

A portable exercise device for use in a doorway or other opening in the home, includes a base with a pair of arms pivotally connected thereto for rotation between a vertical storage position and a horizontal position in which they engage the sides of the opening; adjustable brackets on the outer ends of the arms for centering and securing the base in the opening; a central, multi-section post for mounting in a sleeve on the base and for connection to a top bracket for securing the top of the post to the top of the opening; a pair of multi-section columns for mounting in sockets on the base and connection to the top bracket; a pair of spring assemblies connected to the base and slidable on the columns; pulleys mounted on the top ends of the columns and near the bottom end of the post; and a cable extending around the pulleys to a seat which is slidably mounted on a bar, one end of which is removably mounted in a socket on the base, the bar extending outwardly from the post.

12 Claims, 3 Drawing Sheets

PORTABLE EXERCISE DEVICE FOR USE IN A DOORWAY

BACKGROUND OF THE INVENTION

This invention relates to an exercise device and in particular to a portable exercise device for use in a doorway or other opening.

There are many compact portable exercise devices for use in the home. Most such devices are merely boards for performing sit-ups and the like, with attached racks for holding weights. Small rowing machines are also available for use in the home. There are very few, if any, larger devices of the pull type i.e. of the type including springs and a handle or handles for pulling against the force of the springs. Most such devices are designed to be bolted to a wall or attached to a door by means of a bracket.

The object of the present invention is to provide a relatively simple exercise device of the pull type for use in a doorway or other opening in a home, the device being reaily assembled and disassembled.

BRIEF SUMMARY OF THE INVENTION

Accordingly, the present invention relates to a portable exercise device for use in a doorway or other opening having a top and sides comprising base means for mounting in said opening; post means for detachable connection to said base means and to the top of said opening; arms means extending laterally from said post means for engaging the sides of the opening into engagement with the sides of the opening; seat means for detachable connection to said post means so that the seat means is perpendicular to a plane containing said post means and said arm means; pulley means for mounting on said post means; spring means for connection to said post means; and cable means for extending around said pulley means to said spring means, whereby the user of the device can sit on said seat means and pull said cable means against the force of said spring means.

BRIEF DESCRIPTION OF THE DRAWINGS

The invention will now be described in greater detail with reference to the accompanying drawings which illustrate a preferred embodiment of the invention and wherein.

DESCRIPTION OF THE PREFERRED EMBODIMENT(S)

With reference to the drawings, the preferred embodiment of the exercise device includes a base generally indicated at 1, which is defined by an elongated base plate 2 and an inverted L-shaped mounting on a floor 4 in a doorway 6 or other openings. The base 1 supports a plurality of elements, including a seat assembly, a pair of side brackets, a central post and force resisting assemblies generally indicated at 7, 8, 10 and 11 respectively.

SEAT ASSEMBLY

Figure 2:
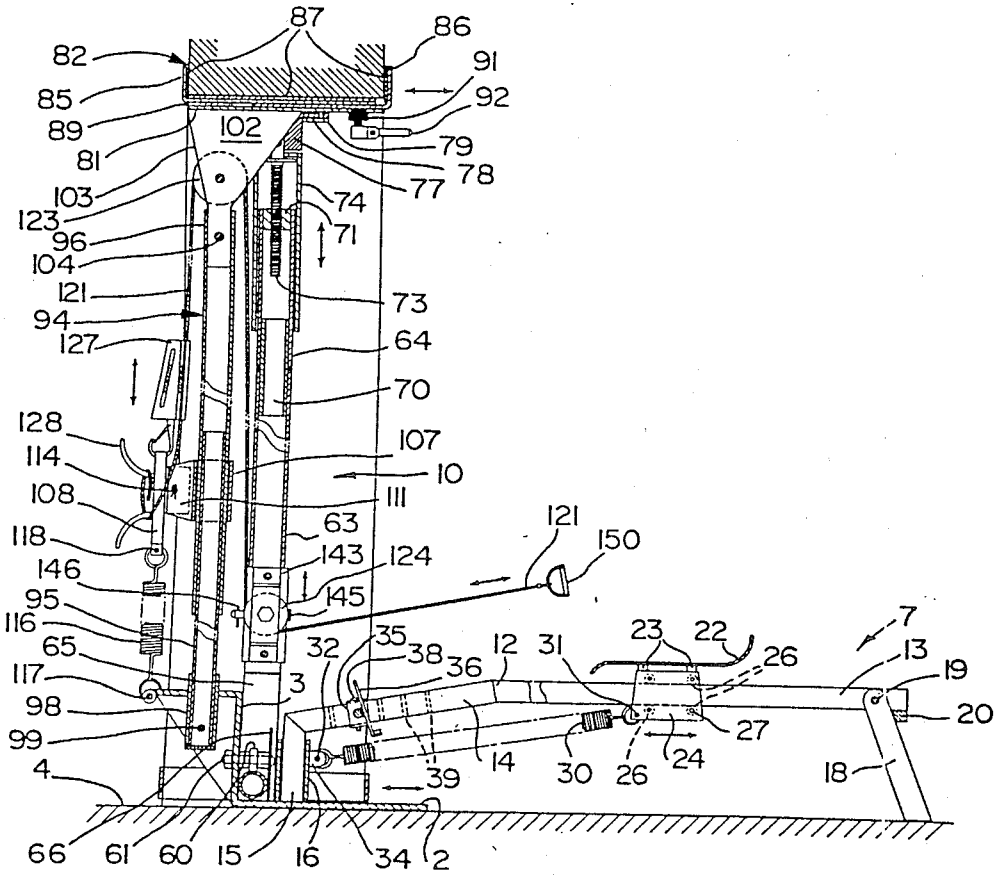
FIG. 2 is a partly sectioned side view of the device of FIG. 1, the sections being taken generally along lines A—A and B—B of FIG. 1.

The seat assembly is defined by an elongated, square cross section tubular bar 12, with a horizontal outer end 13 and an inclined inner end 14. A post 15 on the inner end 14 is inserted into a sleeve 16 on the base plate 2 for holding the assembly in position. A leg 18 is pivotally mounted on the outer end of the bar 12 for rotation around the horizontal axis of a pin 19. A lug 20 connected to the bottom of the bar 12 maintains the leg 18 in the inclined support position (FIG. 2). A seat 22 is slidably mounted on the bar 12. A pair of crossbars 23 extend downwardly from the bottom of the seat 22 between a pair of sides 24 (one shown). Rollers 26 are rotatably mounted on pins 27 extending between the sides 24 for movably supporting the seat on the bar 12. A helical spring 30 is attached at one end to a pin 31 extending between the sides 24 and at the other end to a pin 32 in a clevis 34 on the sleeve 16 for biasing the seat 22 towards the inner end of the horizontal end 13 of the bar 12. A footrest defined by a sleeve 35 and an inclined plate 36 is mounted on the inner end 14 of the bar 12. The sleeve 35 is slidable on the bar 12 and is held in one of a plurality of positions by a pin 38, which can be inserted into any one of a plurality of holes 39 in the bar 12.

SIDE BRACKETS

Figure 3:
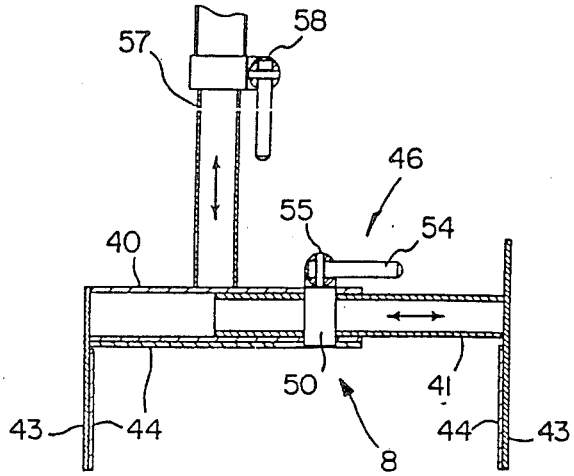
FIG. 3 is a longitudinal sectional view of a side bracket for use in the device of FIGS. 1 and 2.
Figure 4:
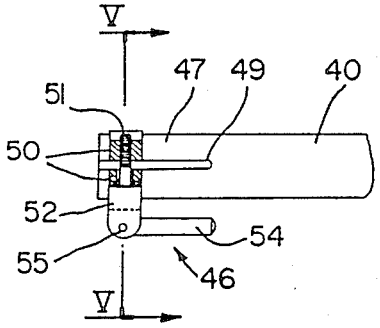
FIG. 4 is a partly sectioned plan view of a quick release used in the bracket of FIG. 3.
Figure 5:
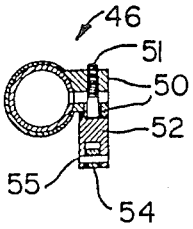
FIG. 5 is a cross section taken generally along the line V—V of FIG. 4.

The side brackets 8 (FIGS. 1 and 3) are generally U-shaped when viewed in plan, and each is defined by telescopic centre tubes 40 and 41 and end plates 43. Flexible pads 44 are provided on the inner surfaces of the plates 43 for preventing damage to the door frame or wall. The tubes 40 and 41 are locked in one position by a quick release coupler generally indicated at 46. The coupler 46 is provided on the outer end 47 of the larger diameter tube 40. For such purpose the end 47 of the tube 40 is split by a longitudinally extending slot 49. A projection 50 is provided on each side of the slot 49, with a screw 51 extending through the projections. The screw 51 is integral with a block 52 and a rod-shaped handle 54 is pivotally connected to the block 52 by a pin 55. Thus the block 52 and the screw 51 can be rotated to move the sides of the slot 49 towards or away from each other, thereby tightening or loosening the tube 40 on the tube 41. Relatively few turns in either direction are required to secure or release the coupler 46. The side brackets 8 are pivotally connected to the back plate 3 by an extensible arm 57. The arm 57 is also defined by telescoping tubes which are held together in one position by a coupler 58 similar to the coupler 46. A lug 60 is provided on the inner end of each arm 56 for receiving a bolt 61 so that the arm can be rotated around the bolt 61 between a vertical storage position and the horizontal use position (FIG. 1).

CENTRAL POST

Figure 1:
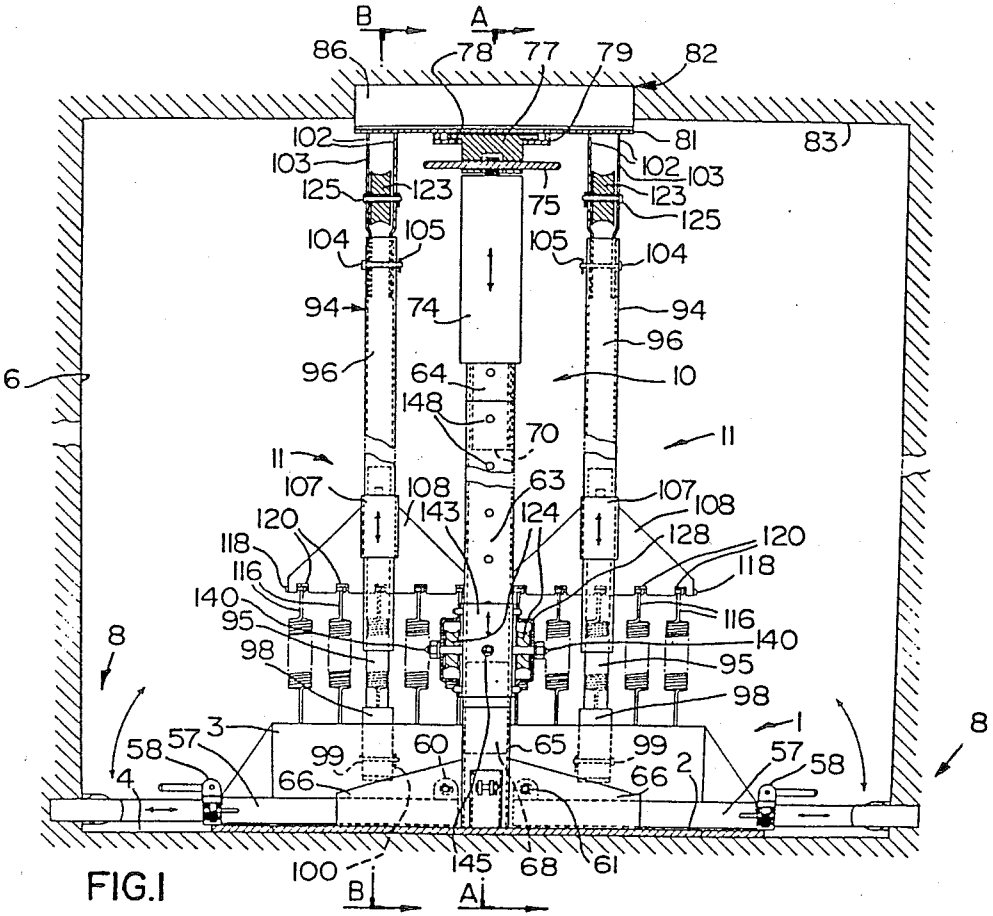
FIG. 1 is a partly sectioned front view of an exercise device in accordance with the present invention.

With reference to FIGS. 1 and 2 the central post 10 is defined by a pair of releasably interconnected tubular sections 63 and 64. The bottom section 63 is connected to a sleeve 65 extending upwardly from the centre of the base plate 2 against the back plate 3. The sleeve 65 is supported by trapezoidal gussets 66 connected to the base plate 2 and to the sleeve 59. A short bar 68 is connected to the bottom end of the post section 63 for extending into the sleeve 65. Similarly a short bar 70 extends out of the top of the section 63 for supporting the section 64. A plug 71 closes the upper end of the top section 64. A long bolt 73 extends downwardly from the closed top end of a sleeve 74 into the plug 71 for supporting the sleeve on the top post section 64. The top end of the bolt 73 extends upwardly through the top end of the sleeve 74 for receiving a pin 75 which pivotally connects the post 10 to a bifurcated block 77. The block 77 is generally T-shaped in cross section, with a top flange 78 mounted in a top bracket 79.

The bracket 79 includes inverted L-shaped sides and ends for supporting the flange 78. The bracket 79 extends downwardly from a top plate 81 which is connected to a top generally U-shaped bracket 82. The bracket 82 is designed to engage the top 83 of the door opening 6. The bracket 82 includes overlapping L-shaped plates 85 and 86. Pads 87 are provided between the plates 85 and 86 and the top 83 of the door opening to prevent damage to the wall or frame. A shim 89 is provided at one end of the top plate 81 for maintaining proper spacing between such plate and the uppermost plate 85. Once in position the plates 85 and 86 are locked together by a bolt (not shown) extending through a short post 91 on the front of the top plate 81 into engagement with the plate 86 for pressing the plates 85 and 86 together. The bolt is turned by a handle 92.

FORCE RESISTING ASSEMBLY

Each force resisting assembly 11 includes a post 94 extending between the back plate 3 and the top plate 81. The post 94 is defined by a pair of telescoping sections 95 and 96, the lower one 95 of which is supported in a socket 98. A straight pin 99 and a cotter pin 100 hold the section 95 in the socket 98. The upper section 96 of the post 94 is connected to the sides 102 of a bracket 103 by a straight pin 104 and a cotter pin 105. The sides 102 extend downwardly from the top plate 81 into the top end of the square cross section post section 96.

A sleeve 107 carrying a generally triangular plate 108 is slidably mounted on each post 94. The plate 108 is connected to the sleeve 107 by a lug 110 extending forwardly between a clevis defined by two plates 111 on the sleeve 107. A straight pin 113 extends through the lug 110 and the plates 111 of the clevis and is held in position by a cotter pin 114.

The sleeve 107 and the plate 108 are biased downwardly by a plurality of helical springs 116 which extend between a pin 117 in the back plate 3 and a pin 118 in the bottom of the plate 108. For such purpose the back plate is notched (not shown) and notches 120 are provided in the bottom end of the plate 108. The plate 108 can be pulled upwardly against the force of the springs 116 by cable 121 extending upwardly from the plate 108 around pulleys 123 and 124. The pulley 123 is mounted on a pin 125 extending between the sides 102 of the bracket 103.

Figure 6:
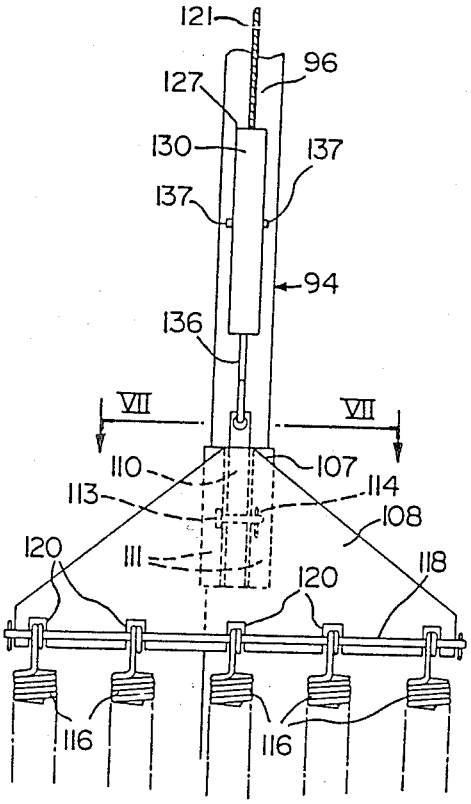
FIG. 6 is a rear view of a force resisting assembly for use in the device of FIGS. 1 and 2.
Figure 8:
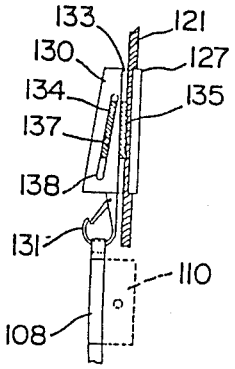
FIG. 8 is an enlarged side view of a portion of the force resisting assembly of FIGS. 6 and 7.
Figure 7:
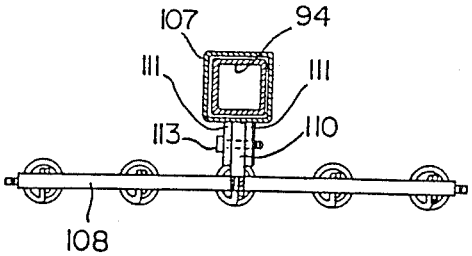
FIG. 7 is a cross section taken generally along line VII—VII of FIG. 6.

One end of the cable 121 passes through a tightener 127 and is wound around a cleat 128 on the plate 108. The tightener 127 (FIGS. 6 and 8) includes a tubular, open ended trapezoidal casing 130 releasably connected to the top end of the plate 108 by a clip 131. The casing 130 contains an upwardly tapering passage 133 containing a tapering wedge 134. The inner, vertical side 135 of the wedge is serrated for gripping the cable 121. Lugs 137 extend outwardly from the sides of the wedge 134 through inclined slots 138 in the sides of the casing 130. Thus the cable 121 can be moved through the casing 130 and the wedge 134 moved upwardly to jam the cable 121 in one position, firmly connecting the cable to the plate 108.

The pulley 124 is rotatably mounted on a stub axle 140 in a casing on one side of a sleeve 143. The sleeve 143 is mounted on the post 63 by means of a straight pin 145 and a cotter pin 146. The sleeve 143 can be moved along the post 63 and the pin 145 positioned in any of a plurality of openings 148. A handle 150 is provided on the other free end of each cable 121.

ASSEMBLY

It will be appreciated that the exercise device can readily be assembled and disassembled. The base 1 is placed in the centre of the doorway 6 and the arms rotated downwardly from the vertical storage position to the horizontal use position. The arm sections are telescoped outwardly so that the brackets 8 engage the sides of the doorway and are locked in position using the coupler 58. The side brackets 8 are closed around the sides of the opening and locked in place using the coupler 46. The top bracket 82 is mounted on the top 83 of the doorway 6 and the sections 63 and 64 of the central post 10 are assembled between the socket or sleeve 65 and the sleeve 74, which is connected to the block 77 using the pin 75. Of course, the base 1 or the top bracket 82 can be moved laterally so that the sockets or sleeves 65 and 74 are vertically aligned. The sections 95 and 96 of the posts 94 are assembled in the sockets 98 and connected to the sides 102 of the brackets 103 using the pins 104 and 105. During assembly of the posts 94 the sleeves 107 are placed on such posts. Finally, the force resisting or spring assemblies 11 are connected to the sleeves 107 and to the cable 121 and the device is ready for use. The reverse steps result in disassembly of the device.

What I claim:

1. A portable exercise device for use in a doorway or similar opening having a top and sides comprising base means for mounting in said opening; adjustable post means for detachable connection to said base means and to the top of said opening; adjustable arm means extending laterally from said post means for engaging the sides of the opening into engagement with the sides of the opening; hinge means pivotally connecting said arm means to said post means whereby said arm means can be rotated between a vertical storage position and a horizontal use position; seat means for detachable connection to said post means, so that the seat means is perpendicular to a plane containing said post means and said arm means; pulley means for mounting on said post means; load means for connection to said post means; and cable means for extending around said pulley means to said load means, whereby the user of the device can sit on said seat means and pull said cable means against the force of said load means.

2. An exercise device according to claim 1, including a plurality of telesopic first tube means defining said post means; and first bracket means for connecting said post means to the top of the opening.

3. An exercise device according to claim 2 including a plurality of telescopic second tube means defining said arm means; and second bracket means for connecting said arm means to the sides of said opening.

4. An exercise device according to claim 1 including sleeve means on said base means for receiving one end of said seat means to releasably connect the seat means to the base means.

5. An exercise device according to claim 4 wherein said seat means includes bar means for extending outwardly from said sleeve means; leg means for supporting the free end of said bar means; a seat slidably mounted on said bar means; and footrest means on said bar means between said post means and said seat means.

6. An exercise device according to claim 1 including a collapsible column means for detachable connection to said base means parallel to said post means, first pulley means on said post means; and second pulley means on said column means, said cable means normally extending around said first and second pulley means.

7. An exercise device according to claim 6 wherein said load means includes plate means for slidable mounting on said column means; and a plurality of springs for connecting said plate means to said base means.

8. An exercise device according to claim 6 or 7 including socket means on said base means for receiving said column means.

9. An exercise device according to claim 7 including cable tightener means for connecting said cable means to said plate means.

10. An exercise device according to claim 1 including first adjustable bracket means on the top end of said post means for engaging the top of said opening.

11. An exercise device according to claim 10 including second adjustable bracket means on the outer ends of said arm means for engaging the sides of the opening.

12. An exercise device according to claim 11 including pin means for detachably connecting said first bracket means to said post means.

* * * * *